US008258469B2

(12) United States Patent
Shiea

(10) Patent No.: US 8,258,469 B2
(45) Date of Patent: Sep. 4, 2012

(54) CYCLING ELECTROSPRAY IONIZATION DEVICE

(75) Inventor: Jentaie Shiea, Kaohsiung (TW)

(73) Assignee: National Sun Yat-Sen University, Kaohsiung (TW)

( * ) Notice: Subject to any disclaimer, the term of this patent is extended or adjusted under 35 U.S.C. 154(b) by 148 days.

(21) Appl. No.: 12/914,796

(22) Filed: Oct. 28, 2010

(65) Prior Publication Data

US 2011/0220787 A1 Sep. 15, 2011

(30) Foreign Application Priority Data

Mar. 15, 2010 (TW) ..... 99107458 A

(51) Int. Cl.
*H01J 49/10* (2006.01)

(52) U.S. Cl. ..... 250/288; 250/281; 250/282; 250/423 R

(58) Field of Classification Search ..... 250/281, 250/282, 288, 423 R, 424, 426, 423 F
See application file for complete search history.

(56) References Cited

U.S. PATENT DOCUMENTS

2009/0302211 A1* 12/2009 Takats ..... 250/282
* cited by examiner

*Primary Examiner* — Michael Maskell
*Assistant Examiner* — Hanway Chang
(74) *Attorney, Agent, or Firm* — Foley & Lardner LLP

(57) ABSTRACT

A cycling electrospray ionization device includes a driving mechanism and a nozzle. The nozzle is configured to sequentially form liquid droplets of an electrospray medium thereat, and is adapted to establish a traveling path with a receiving unit of a mass spectrometer such that when a potential difference is applied between the nozzle and the receiving unit to lade the liquid droplets with a plurality of electric charges for ionizing analytes to form ionized analytes, the charged droplets are forced to move toward the receiving unit along the traveling path. The nozzle defines a nozzle axis, and is driven by the driving mechanism to proceed with a cycling route about a cycling axis such that the nozzle axis tracks along the cycling route, and such that immediately after leaving the nozzle, the liquid droplets cooperate to form a substantially columnar plume with a cross section substantially surrounded by the cycling route.

15 Claims, 15 Drawing Sheets

CYCLING ELECTROSPRAY IONIZATION DEVICE

CROSS-REFERENCE TO RELATED APPLICATION

This application claims priority of Taiwanese Application No. 099107458, filed on Mar. 15, 2010.

BACKGROUND OF THE INVENTION

1. Field of the Invention

The invention relates to an electrospray ionization (ESI) device, more particularly to a cycling electrospray ionization device that is adapted to produce liquid droplets of an electrospray medium in a moving manner.

2. Description of the Related Art

Through mass spectrometry, the molecular weights of analytes obtained from a sample can be obtained for identification of the analytes. A mass spectrometer generally includes an ionization device, a mass analyzer and a detector.

One ionization method is called electrospray ionization (ESI). As shown in FIG. 1, a conventional electrospray ionization device 11 performs an electrospray ionization procedure to ionize analytes contained in an electrospray solution. The conventional electrospray ionization device 11 includes a nozzle 112 having an open end 111 that opens toward an entrance side 121 of a mass analyzer 12 of an electrospray ionization mass spectrometer. When in use, an electric field, for instance, a 2~5 kV potential difference, is established between the open end 111 of the nozzle 112 and the entrance side 121 of the mass analyzer 12. Subsequently, the electrospray solution is forced out of the nozzle 112 for traveling toward the open end 111. The electrospray solution forms a Taylor cone 2 that is filled with electric charges as it passes through the open end 111 of the nozzle 112 due to the combined effect of the electric field present between the open end 111 of the nozzle 112 and the entrance side 121 of the mass analyzer 12 and the surface tension of the electrospray solution at the open end 111. As the electric field force overcomes the surface tension of the electrospray solution at the open end 111 of the nozzle 112, liquid droplets containing multivalent electric charges and analytes are formed, and are forced to enter into the mass analyzer 12 through the entrance side 121 thereof.

As the charged droplets travel through the air from the open end 111 of the nozzle 112 toward the entrance side 121 of the mass analyzer 12, the liquid portion of the charged droplets vaporize such that the charged droplets dwindle in size, causing the multivalent electrons to attach to the analytes to form ionized analytes with relatively lower m/z values (i.e., the mass-to-charge ratio, where m is the mass of the ionized analyte, and z is the ionic charge/number of elementary charges). Since the molecular weight of a macromolecule, such as a protein molecule, is in the hundreds of thousands, charges attached to each of the macromolecules for forming the ionized molecules needs to be multivalent in order for the m/z value to be low enough so as to be detectable by the mass analyzer 12. Not only does the electrospray ionization method allow macromolecules to be efficiently ionized, but it also overcomes the detection limit imposed by the mass analyzer 12 since a lower m/z value can be obtained. Therefore, protein molecules can be studied using electrospray ionization mass spectrometry.

Several improvements have been developed for electrospray ionization in the past. As shown in FIG. 2, U.S. Pat. Nos. 6,350,617 and 6,621,075 disclose another conventional electrospray ionization device 11*a* including a rotary disk 113, and a plurality of nozzles 112 that are mounted on the rotary disk 13 and that are supplied respectively with a plurality of different electrospray sample solutions. The rotary disk 113 is rotatable, such that when it is required to perform electrospray ionization on a particular one of the electrospray sample solutions, a selected one of the nozzles 112 can be moved into a designated location relative to the mass analyzer 12 so as to permit the selected electrospray sample solution to enter into the mass analyzer 12. As shown in FIG. 3, U.S. Pat. No. 6,066,848 discloses another conventional electrospray ionization device 11*b* including an array of nozzles 112 respectively for spraying a plurality of different electrospray sample solutions, and a blocking device 114 adapted to be disposed between the nozzles 112 and the entrance side 121 of the mass analyzer 12 and formed with an aperture 115. The blocking device 114 is angularly movable relative to the nozzles 112 so as to permit the aperture 115 to be brought into alignment with a selected one of the nozzles 112. As a result, only the liquid droplets of the selected electrospray sample solution are permitted to pass through the aperture 115 thereby advancing toward the entrance side 121 of the mass analyzer 12 for mass analysis per each time. In other words, each of the conventional electrospray ionization devices 11*a*, 11*b* facilitates convenient electrospray ionization when multiple electrospray sample solutions are to be analyzed.

However, all conventional electrospray ionization devices, including those disclosed above, have the same disadvantage that during electrospray ionization of each single electrospray solution, the corresponding nozzle 112 is fixed in position when spraying the electrospray solution, such that only a portion of the ionized analytes will reach the mass analyzer 12 via the entrance side 121, while the other are dispersed into the surrounding environment due to the space charge phenomenon. As a result, intensity and stability of signals obtained by the mass analyzer 12 corresponding to the analytes are relatively low.

In view of the above, it would be significantly beneficial to the electrospray ionization mass spectrometry (ESI-MS) industry if the amount of ionized analytes reaching the mass analyzer 12 can be increased.

SUMMARY OF THE INVENTION

Therefore, the object of the present invention is to provide an electrospray ionization device that can eliminate the aforesaid drawbacks of the prior art.

According to the pre sent invention, there is provided a cycling electrospray ionization device that is adapted for use in a mass spectrometer which is for analyzing analytes, and which includes a receiving unit disposed to admit therein ionized analytes obtainable through ionization of the analytes. The cycling electrospray ionization device includes a driving mechanism and at least one nozzle. The nozzle is configured to sequentially form liquid droplets of an electrospray medium thereat, and is adapted to establish a traveling path with the receiving unit such that when a potential difference is applied between the nozzle and the receiving unit to lade the liquid droplets with a plurality of electric charges for ionizing the analytes to form the ionized analytes, the charged droplets are forced to move toward the receiving unit along the traveling path. The nozzle defines a nozzle axis, and is driven by the driving mechanism to proceed with a cycling route about a cycling axis such that the nozzle axis tracks along the cycling route, and such that immediately after leaving the nozzle, the liquid droplets cooperate to form a substantially columnar plume with a cross section substantially surrounded by the cycling route.

The present invention also provides a mass spectrometer that includes the abovementioned cycling electrospray ionization device, and a receiving unit that is disposed to admit therein ionized analytes obtainable through ionization of the analytes.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
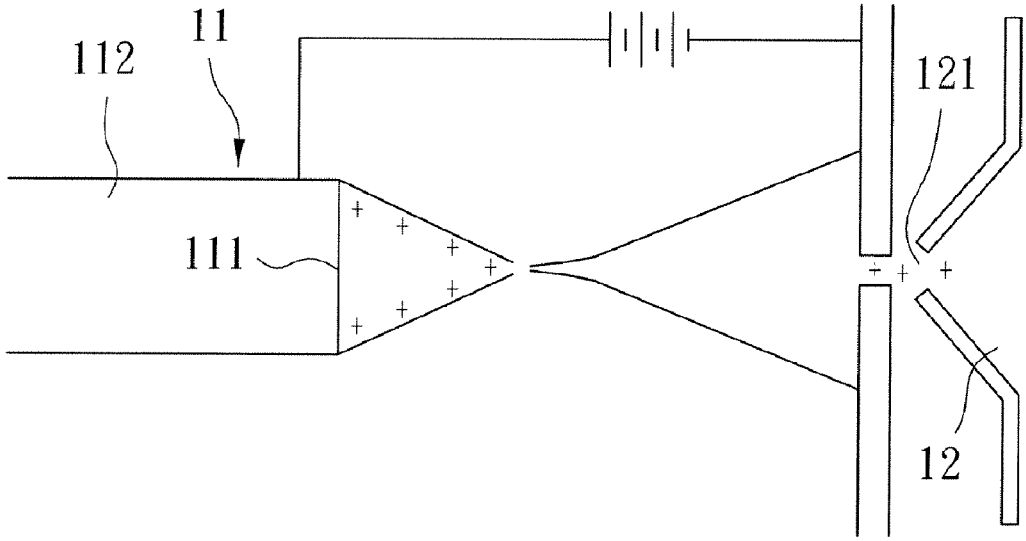
FIG. 1 PRIOR ART
FIG. 1 is a schematic view, illustrating a conventional electrospray ionization device.
Figure 2:
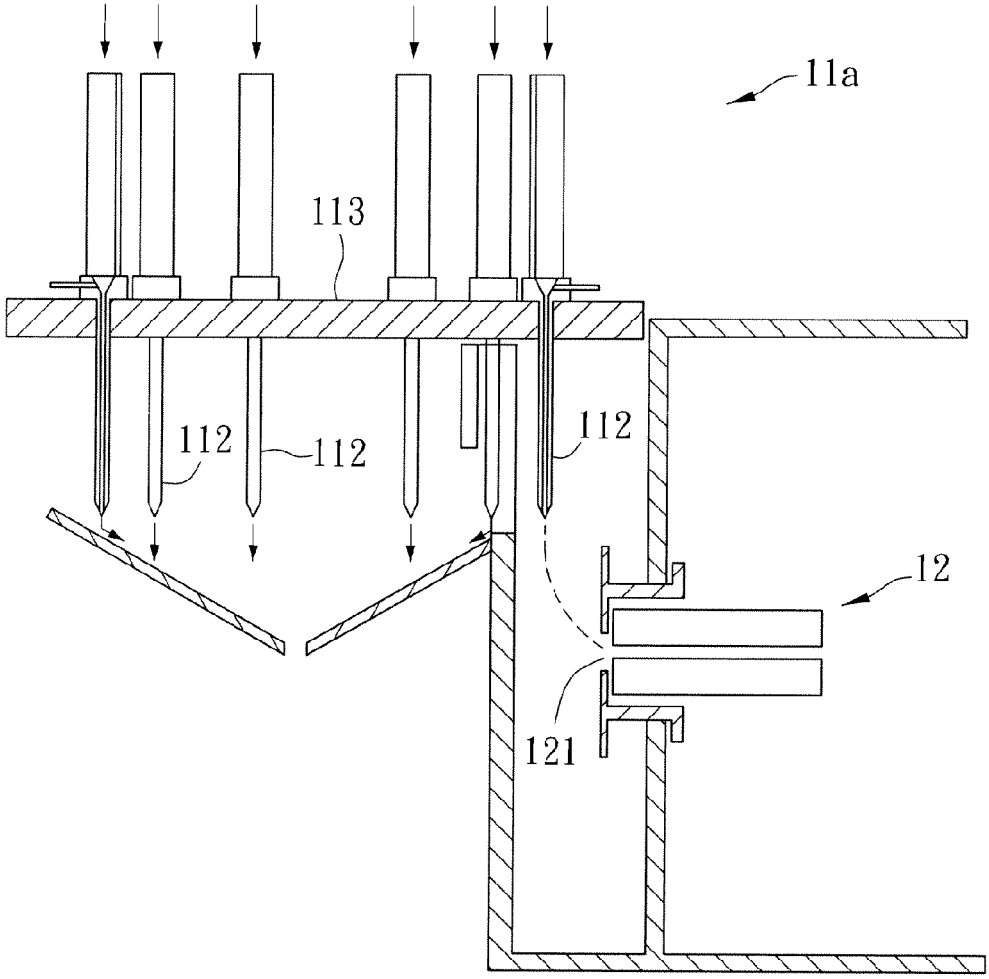
FIG. 2 PRIOR ART
FIG. 2 is a schematic view of another conventional electrospray ionization device as disclosed in U.S. Pat. Nos. 6,350,617 and 6,621,075.
Figure 3:
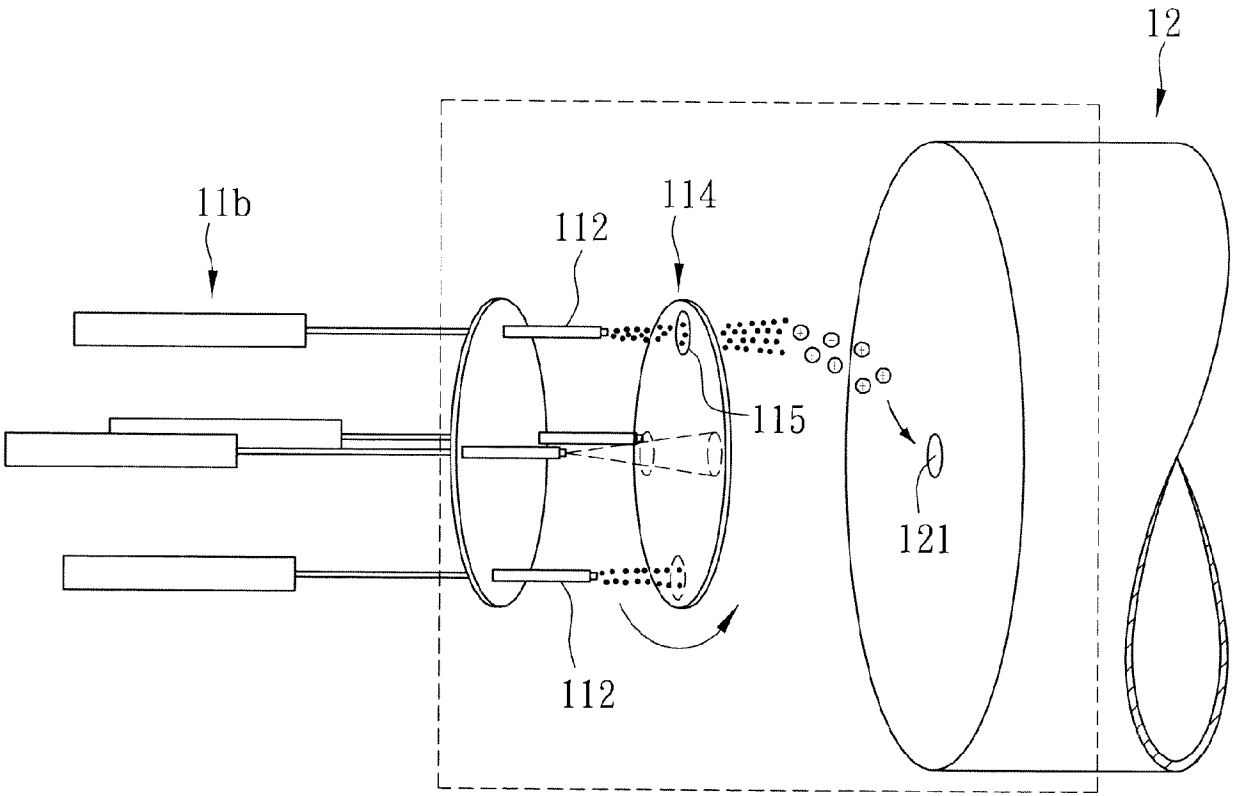
FIG. 3 PRIOR ART
FIG. 3 is a schematic view of yet another conventional electrospray ionization device as disclosed in U.S. Pat. No. 6,066,848.

Before the present invention is described in greater detail, it should be noted that like elements are denoted by the same reference numerals throughout the disclosure.

Figure 4:
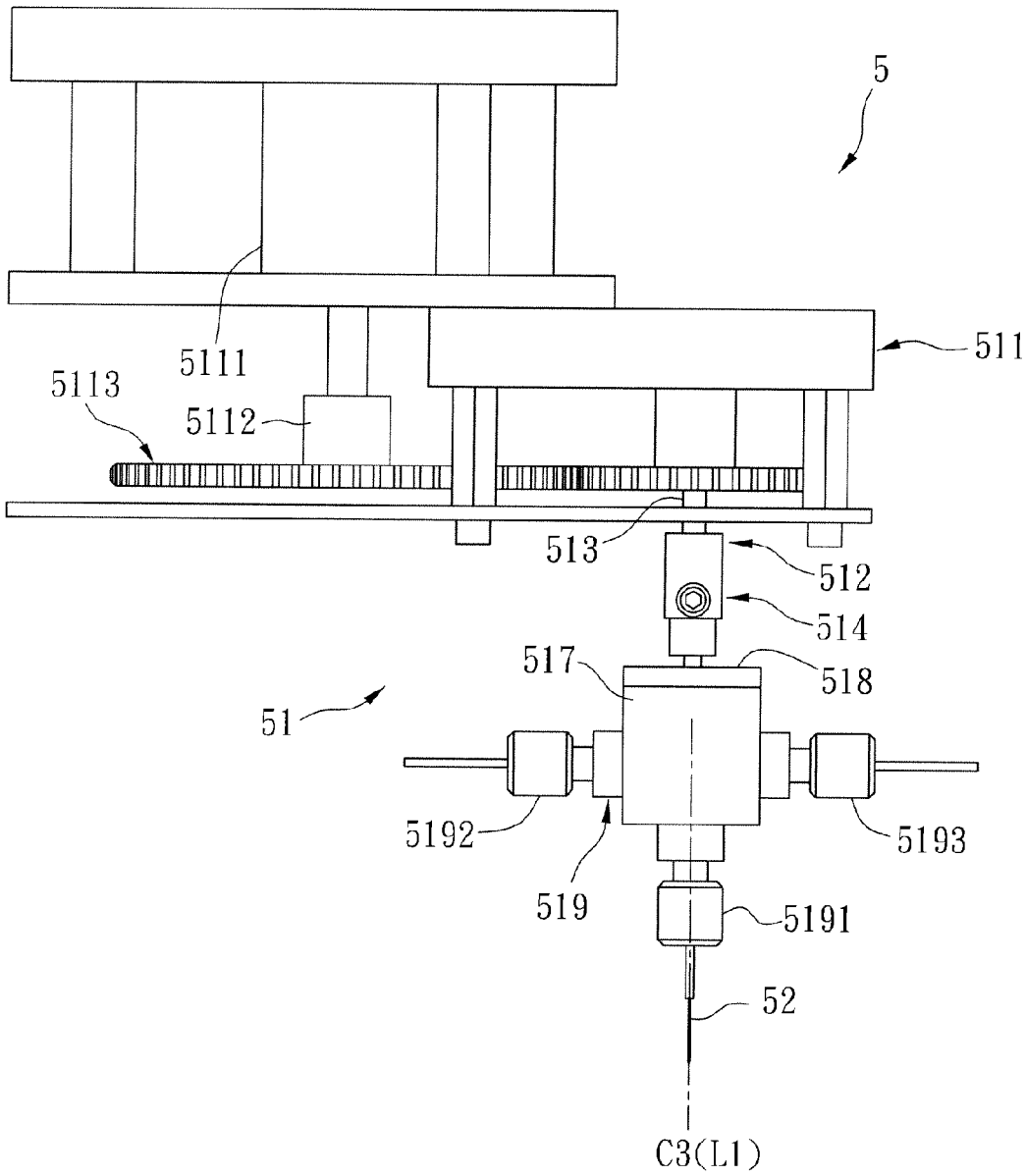
FIG. 4 is a schematic top view of the first preferred embodiment of a cycling electrospray ionization (RESI) device according to the present invention.
Figure 5:
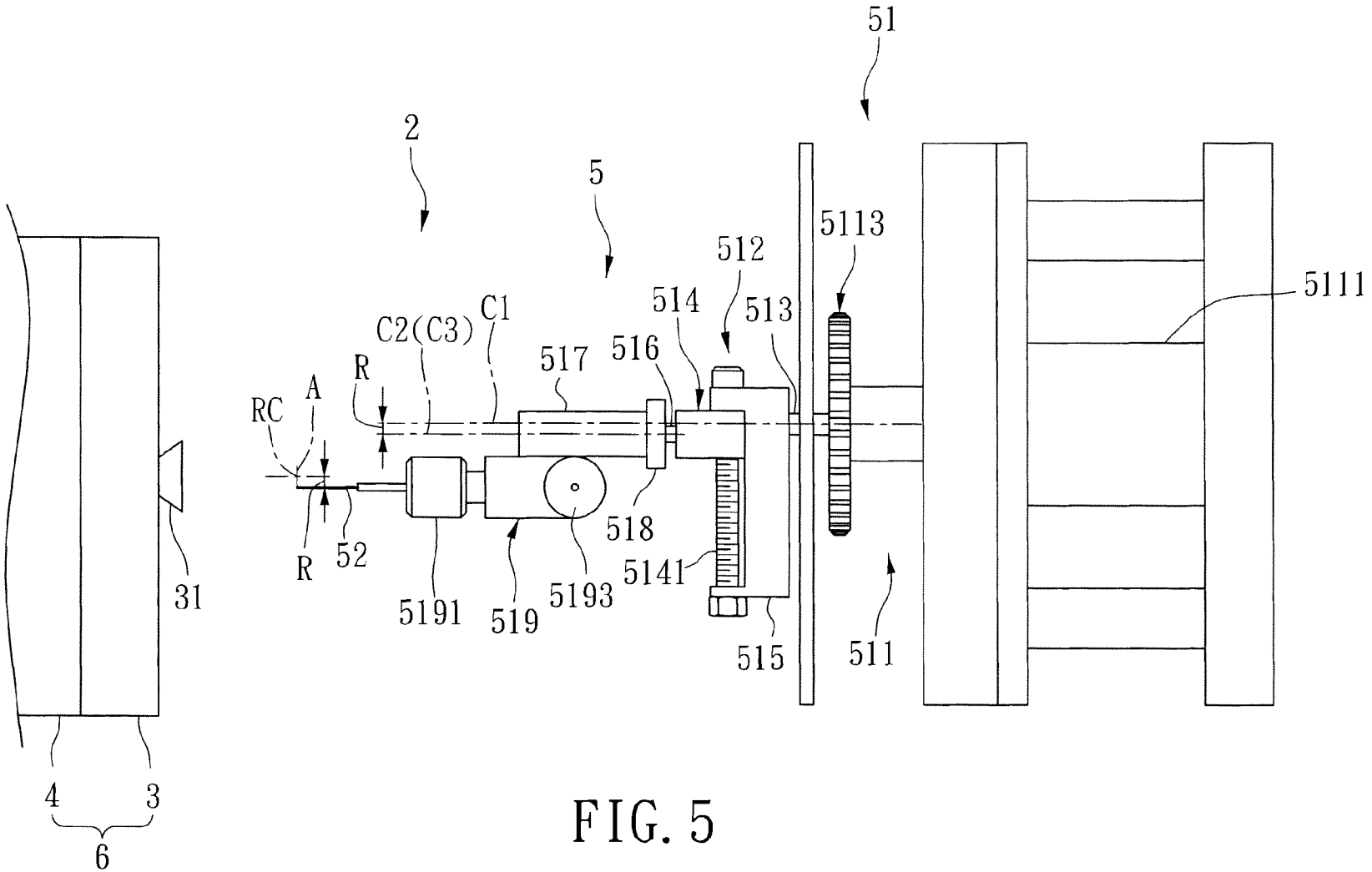
FIG. 5 is a schematic side view of the first preferred embodiment.

With reference to FIG. 4 and FIG. 5, the first preferred embodiment of a cycling electrospray ionization device 5 according to the present invention is adapted for use in a mass spectrometer 2. The mass spectrometer 2 is for analyzing analytes, and includes amass analyzer 3 and a detector 4, which are integrally referred to as a receiving unit 6 hereinafter. In other words, an entrance side 31 of the mass analyzer 3 is also interchangeably referred to as the entrance side of the receiving unit 6. The receiving unit 6 is disposed to admit therein ionized analytes obtainable through ionization of the analytes for subsequent mass spectrometric analysis.

The cycling electrospray ionization device 5 includes a driving mechanism 51 and at least one nozzle 52. The nozzle 52 is configured to sequentially form liquid droplets of an electrospray medium thereat, and is adapted to establish a traveling path with the receiving unit 6, such that when a potential difference is applied between the nozzle 52 and the receiving unit 6 to lade the liquid droplets with a plurality of electric charges for ionizing the analytes to form the ionized analytes, the charged droplets are forced to move toward the receiving unit 6 along the traveling path. Further, the nozzle 52 defines a nozzle axis (L1), and is driven by the driving mechanism 51 to proceed with a cycling route (A) about a cycling axis (RC) such that the nozzle axis (L1) tracks along the cycling route (A), and such that immediately after leaving the nozzle 52, the liquid droplets cooperate to form a substantially columnar plume with a cross section substantially surrounded by the cycling route (A).

In this embodiment, the cycling route is a revolving route (A), and is demonstrated in circular shape. It should be noted herein that the cycling route certainly could be in other looped forms. In an extreme case, the cycling route may substantially be configured into a reciprocating route. This is achieved by straightening two half-route segments of the cycling route that are opposite in location to each other relative to the cycling axis, and opposite in direction of movement to each other so as to bring the half-route segments close to each other to thereby substantially render the cycling route into the reciprocating route. It should be further noted herein that the cycling axis (RC) is referred to hereinafter as "revolving axis (RC).

The driving mechanism 51 includes a primary drive module 511 and a revolving drive module 512. The primary drive module 511 includes an output shaft unit 513 that rotates about a rotating axis unit (C1). The revolving drive module 512 includes a revolving shaft unit 514 that defines a shaft axis unit (C2) offset from the rotating axis unit (C1) by a predetermined distance (R), and that has a proximate end unit 515 coupled to the output shaft unit 513 so as to be driven to revolve about the rotating axis unit (C1), and a distal end unit 516 coupled to the nozzle 52 so as to bring the revolving route (A) into a predetermined correlation with the predetermined distance (R).

In this embodiment, the rotating axis unit includes one rotating axis (C1), and the output shaft unit includes one output shaft 513 that rotates about the rotating axis (C1). In addition, the shaft axis unit includes one shaft axis (C2) offset from the rotating axis (C1) by the predetermined distance (R). The revolving shaft unit includes a revolving shaft 514 that defines the shaft axis (C2), and that includes a proximate end part 515 and a distal end part 516. The proximate end part 515 constitutes the proximate end part unit, and is coupled to the output shaft 513 so as to be driven to revolve about the rotating axis (C1). The distal end part 516 constitutes the distal end unit, and is coupled to the nozzle 52 so as to bring the revolving route (A) into the predetermined correlation with the predetermined distance (R). Moreover, the revolving shaft 514 further includes an adjusting rod 5141 for coupling the distal end part 516 to the proximate end part 515 at a predetermined one of a plurality of positions such that the predetermined distance (R) between the rotating axis (C1) and the shaft axis (C2) is adjustable.

It should be noted herein that although it is shown that the revolving axis (RC) is not aligned with the rotating axis (C1) in this embodiment, the revolving axis (RC) may be aligned with the rotating axis (C1) in other embodiments of the present invention if only the predetermined correlation of the revolving route (A) with the predetermined distance (R) remains unchanged.

Moreover, in this embodiment, the driving mechanism 51 further includes a coupler 517 having a major wall 518. The major wall 518 defines a centerline (C3) normal thereto, and is configured to secure the nozzle 52 relative thereto so as to render the centerline (C3) to be oriented parallel to the nozzle axis (L1) in a direction of the nozzle axis (L1). The major wall 518 is configured to have therein a tubular bearing surface (not shown), which is configured to engage the distal end part 516 of the revolving shaft 514 such that the revolving route (A) is kept in the predetermined correlation with the predetermined distance (R).

The rotating electrospray ionization device 5 further includes a three-way pipe 519 disposed to couple the nozzle 52 to the major wall 518 of the coupler 517 so as to secure the nozzle 52 relative thereto. The three-way pipe 519 has a first conduit 5191 which is disposed upstream of the nozzle 52, a second conduit 5192 which is disposed upstream of the first conduit 5191, and which has an inlet for introducing therein the electrospray medium, and a third conduit 5193 which is disposed downstream of the second conduit 5192 and upstream of the first conduit 5191, and which has a port that is fit with an electrode for establishing the potential difference with the receiving unit 6. In this embodiment, the three-way pipe 519 is mounted to a bottom surface of the coupler 517 such that the nozzle 52 is disposed below the coupler 517. In this embodiment, the analytes are contained in the electrospray medium.

Moreover, the primary drive module 511 further includes a motor 5111 with a main drive shaft 5112, and a gear train 5113 disposed to transmit a drive force of the main drive shaft 5112 to drive the output shaft 513.

Preferably, the nozzle 52 is a capillary formed with an outlet that is configured to sequentially form the liquid droplets of the electrospray medium thereat. Alternatively, the nozzle 52 can be configured to form the liquid droplets by utilizing the piezoelectric or thermal bubble technology similar to that used in inkjet printers.

The electrospray medium forming the liquid droplets is a solution normally used in electrospray ionization methods, examples of which include solutions containing protons ($H^+$) or ions such as $OH^-$, etc. Since this aspect should be well known to those skilled in the art, further details of the same will be omitted herein for the sake of brevity. In general, a solution containing protons or $OH^-$ ions is used as the electrospray medium. The protons can be obtained through addition of an acid into the solution. With an electric field direction pointing away from the nozzle 52 toward the receiving unit 6, a plurality of "positively charged liquid droplets" can be formed. This is the so-called "positive ion mode" electrospray ionization mass spectrometry. Conversely, the $OH^-$ ions can be added through addition of a base into the solution. With an electric field direction pointing away from the receiving unit 6 toward the nozzle 52, a plurality of "negatively charged liquid droplets" can be formed. This is the so-called "negative ion mode" electrospray ionization mass spectrometry.

In order to facilitate interpretation of resultant mass spectra obtained through electrospray ionization mass spectrometry (ESI-MS), a "positive ion mode" involving charged liquid droplets that contain protons ($H^+$) is normally used for mass spectrometric analysis incorporating the electrospray technique. Thus, preferably, the electrospray medium is a solution containing an acid. More preferably, the electrospray medium is a solution containing a volatile liquid such that the liquid portion in the liquid droplets can vaporize prior to the receipt of the ionized analytes by the receiving unit 6 so as to simplify the resultant mass spectra.

Alternatively, a gas supplying mechanism (not shown) may be provided between the rotating electrospray ionization device 5 and the receiving unit 6 to provide a non-reactive gas for assisting vaporization of the volatile liquid. Preferably, the non-reactive gas is blown toward the receiving unit 6, and has a temperature that ranges from room temperature to 325° C. Preferably, the non-reactive gas is selected from the group consisting of nitrogen gas, helium gas, neon gas, argon gas, and a combination thereof.

Figure 6:
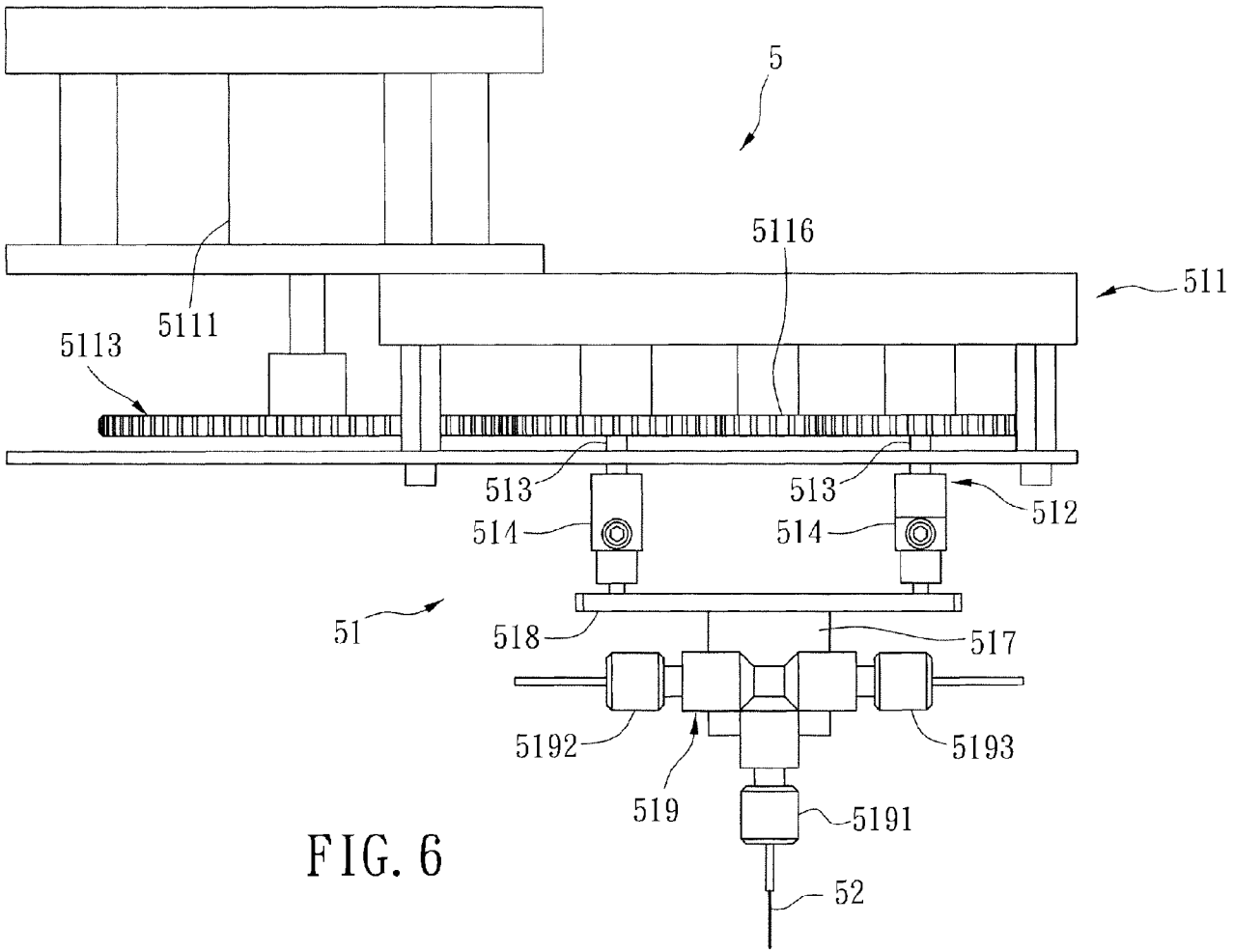
FIG. 6 is a schematic top view of the second preferred embodiment of a cycling electrospray ionization device according to the present invention.
Figure 7:
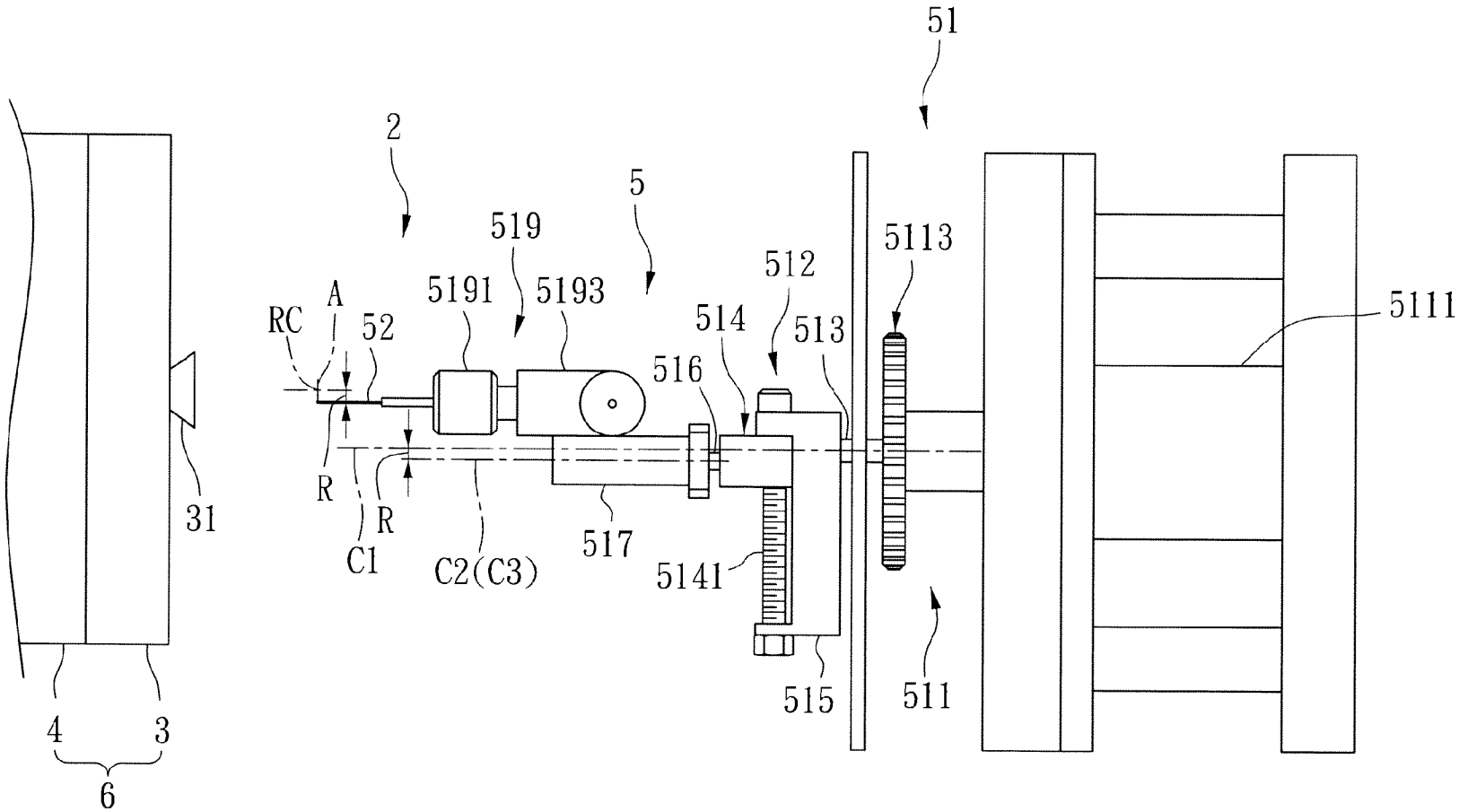
FIG. 7 is a schematic side view of the second preferred embodiment.

With reference to FIG. 6 and FIG. 7, the second preferred embodiment of a rotating electrospray ionization device 5 according to the present invention differs from the first preferred embodiment in that the rotating axis unit of the rotating electrospray ionization device 5 includes two rotating axes (C1), and the output shaft unit of the rotating electrospray ionization device 5 includes two output shafts 513 to rotate respectively about the two rotating axes (C1). Correspondingly, the shaft axis unit of the rotating electrospray ionization device 5 includes two shaft axes (C2), and the revolving shaft unit of the revolving drive module 512 of the rotating electrospray ionization device 5 includes two revolving shafts 514 which respectively define the two shaft axes (C2) (the two shaft axes (C2) seem to be coincidental from the perspective of FIG. 7). Each of the shaft axes (C2) is offset from a corresponding one of the rotating axes (C1) by the predetermined distance (R). Each of the revolving shafts 514 has a proximate end part 515 and a distal end part 516. The proximate end part 515 of each of the revolving shafts 514 is coupled to a corresponding one of the output shafts 513 so as to be driven to revolve about a corresponding one of the rotating axes (C1).

In addition, the major wall 518 of the coupler 517 according to the second preferred embodiment is configured to have therein two tubular bearing surfaces which are disposed equidistant from the centerline (C3) of the major wall 518, and which are respectively configured to engage the distal end parts 516 of the two revolving shafts 514 such that the revolving route (A) is kept in the predetermined correlation with the predetermined distance (R). Moreover, in this embodiment, the three-way pipe 519 is mounted to a top surface of the coupler 517 such that the nozzle 52 is disposed above the coupler 517.

Figure 8:
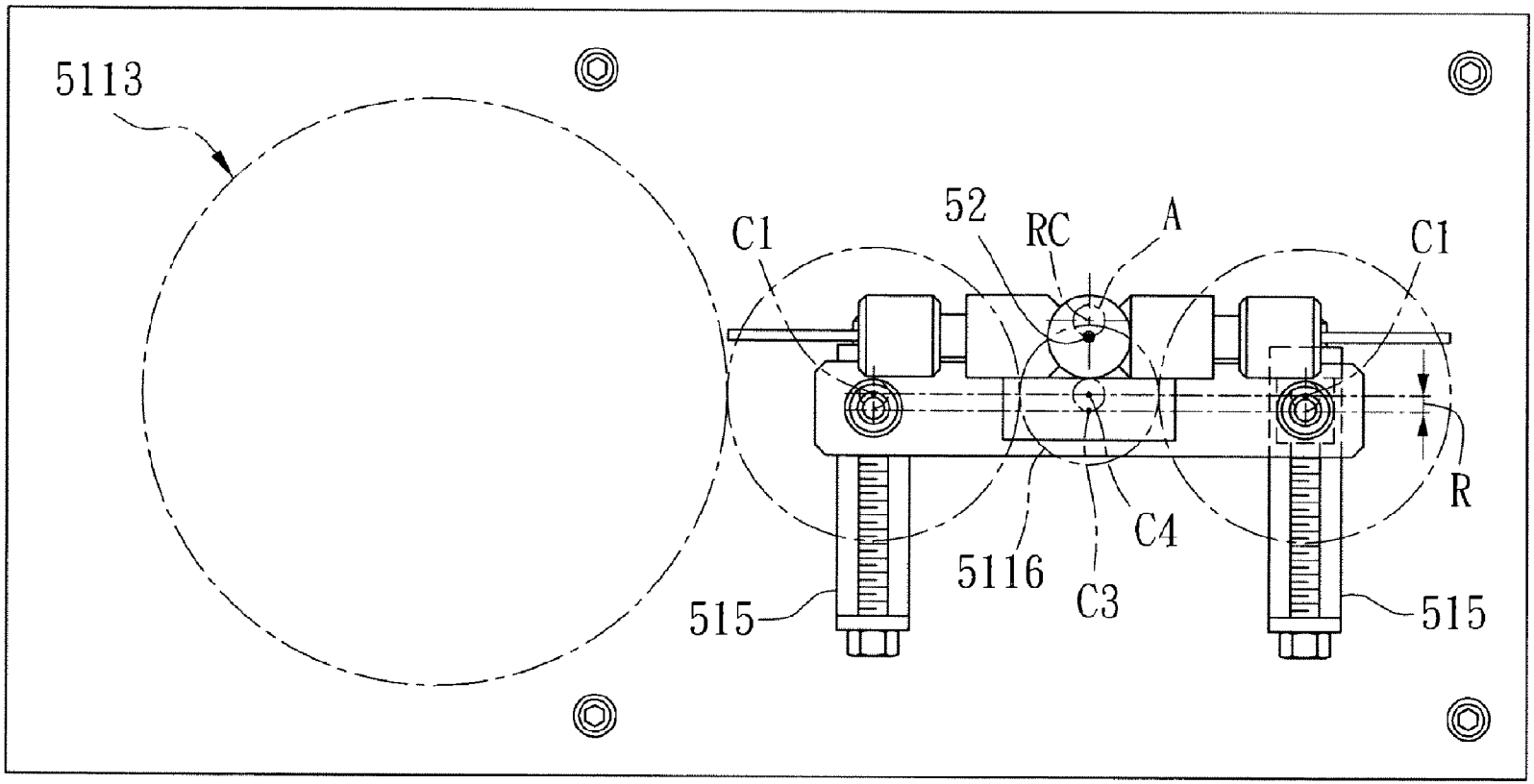
FIG. 8 is a schematic front view of the second preferred embodiment, illustrating a nozzle disposed at the lowest point in a revolving route.
Figure 9:
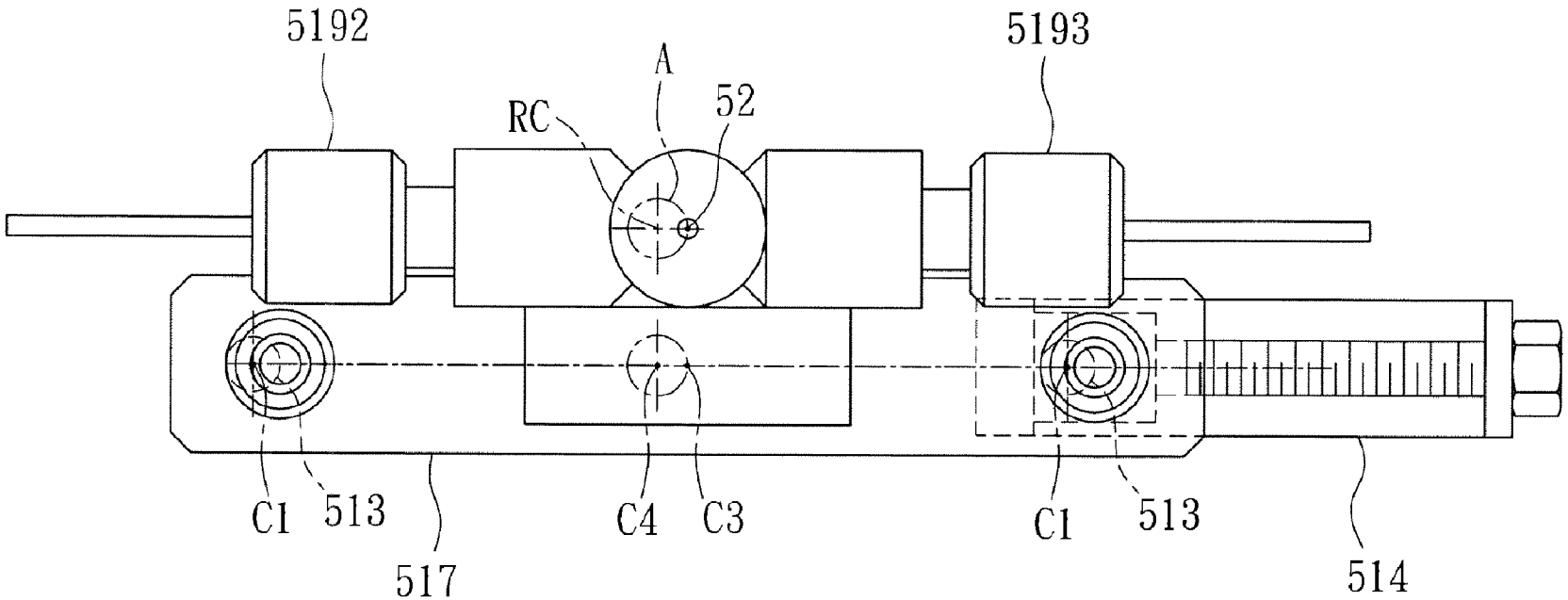
FIG. 9 is a fragmentary schematic front view of the second preferred embodiment, illustrating the nozzle disposed at the rightmost point in the revolving route.

Furthermore, according to the second preferred embodiment, the gear train 5113 of the primary drive module 511 of the driving mechanism 51 includes an idler gear 5116 to ensure that the two output shafts 513 rotate in the same circumferential direction and respectively about the two rotating axes (C1). With reference to FIG. 8 and FIG. 9, the coupler 517 as a whole revolves about a central axis (C4) parallel to the two rotating axes (C1) and intersected by a straight line that connects the two rotating axes (C1) at a midpoint of the straight line, while bringing the nozzle 52 to revolve about the revolving axis (RC) along the revolving route (A). In this embodiment, each of the revolving shafts 514, the coupler 517, and the nozzle 52 revolves along a circular path that has a radius equal to the predetermined distance (R).

As shown in FIG. 8, when the two revolving shafts 514 are disposed at a lowest point about their corresponding circular paths, the nozzle 52 is disposed at the lowest point about the revolving route (A). As shown in FIG. 9, when the two revolving shafts 514 are disposed at the rightmost point about their corresponding circular paths, the nozzle 52 is disposed at the rightmost point about the revolving route (A).

Figure 10:
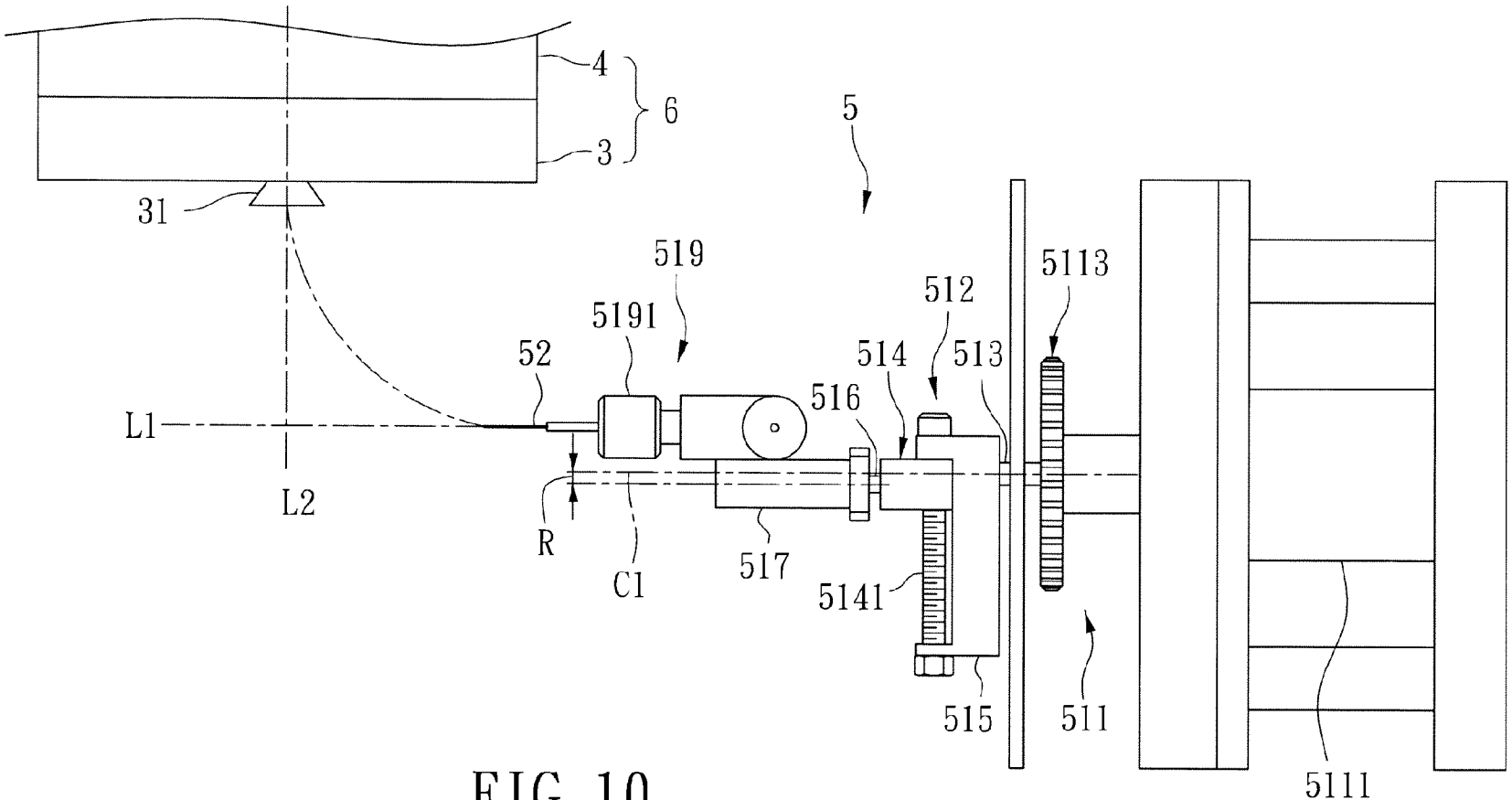
FIG. 10 is a schematic side view, illustrating a different arrangement between the cycling electrospray ionization device and a receiving unit of a mass spectrometer.

It should be noted herein that the traveling path established between the nozzle 52 and the receiving unit 6 is substantially straight in the previous embodiments. However, as shown in FIG. 10, it is common in the electrospray ionization mass spectrometry (ESI-MS) industry for the nozzle axis (L1) of the nozzle 52 to have a substantially perpendicular relationship with an entrance axis (L2) defined by the receiving unit 6. In this instance, due to the potential difference established between the nozzle 52 and the receiving unit 6, the traveling path taken by the liquid droplets of the electrospray medium is not straight, but curved. The rotating electrospray ionization device 5 of the present invention may also be applicable to this type of mass spectrometer configuration.

Figure 11:
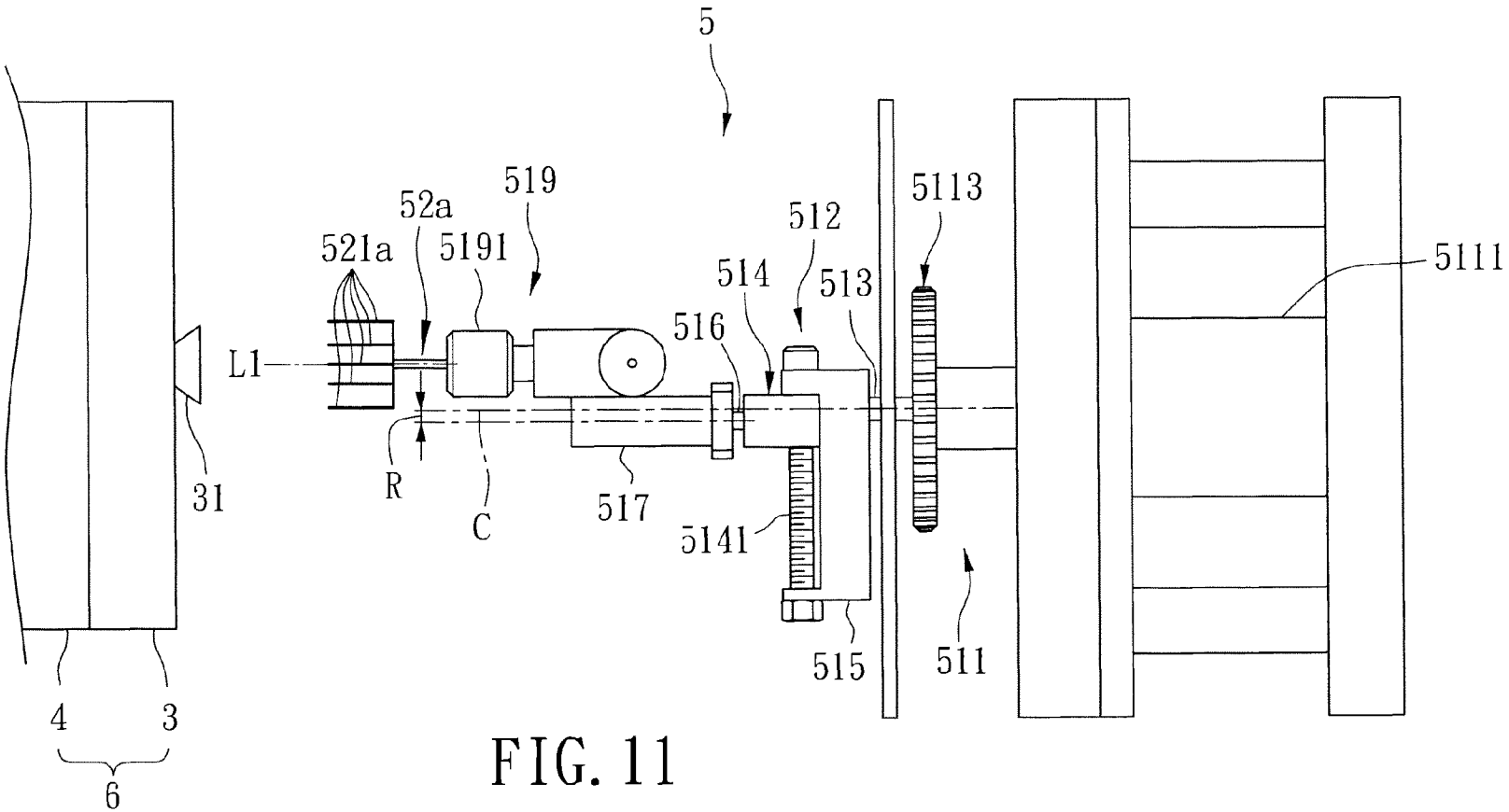
FIG. 11 is a schematic side view of the third preferred embodiment of a cycling electrospray ionization device according to the present invention, in which a first array of plural sub-nozzles are illustrated.

With reference to FIG. 11, according to the third preferred embodiment of a rotating electrospray ionization devices according to the present invention, the nozzle 52*a* of the rotating electrospray ionization device 5 according to the third preferred embodiment is manifolded into a plurality of sub-nozzles 521 that are parallel to the nozzle axis (L1). FIG. 11 illustrates a first array of the plural sub-nozzles 521. At least two of the sub-nozzles 521 are symmetrical relative to the nozzle axis (L1). The sub-nozzles 521 receive the same electrospray medium from the first conduit 5191 of the three-way pipe 519, and are each configured to sequentially form liquid droplets of the electrospray medium thereat. The nozzle axis (L1) still revolves about the revolving axis (RC) along the revolving route (A). Looking from the perspective of a single sub-nozzle 521, however, each of the sub-nozzles 521 has its own revolving axis, and revolves along its own revolving route.

Figure 12:
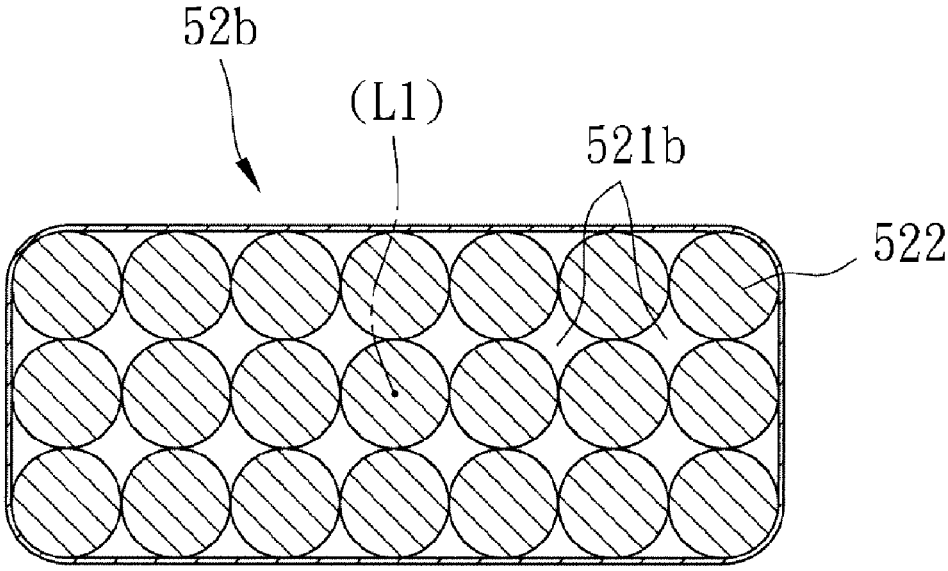
FIG. 12 illustrates a second array of the plural sub-nozzles in a schematic sectional view of the third preferred embodiment as shown in FIG. 11.

Alternatively, as shown in FIG. 12, the nozzle 52*b* can be manifolded into a second array of the plural sub-nozzles 521*b* by forming a pack of interconnected solid columns 522, where the spaces between the solid columns 522 serve as the sub-nozzles 521*b* and permit the electrospray medium to pass therethrough to form the liquid droplets.

Optionally, the coupler 517 is movable toward or away from the receiving unit 6, such that a three-dimensional spiral revolving path can be obtained by combining an axial movement of the coupler 517 with a revolving movement of the nozzle 52.

Optionally, the electrospray medium can be introduced into the rotating electrospray ionization device 5 by a syringe pump.

When a sample, from which the analytes are obtained, is a mixture, liquid chromatography (LC) or capillary electrophoresis (CE) techniques may be used for separation of the analytes prior to introducing the analytes into the nozzle 52.

It should be noted herein that the magnitude of the potential difference and the direction of the electric field established between the nozzle 52 and the mass analyzer 3 is set such that the electrospray medium is enabled to form into multiple-charged liquid droplets. The potential difference can be either positive or negative as is determined by the user according to the desired electric property of the multiple-charged liquid droplets. The potential difference should be established with respect to the design of the mass analyzer 3, for example, by applying a voltage above 2 kV at the nozzle 52 of the rotating electro spray ionization device 5 and grounding the mass analyzer 3, or by grounding the nozzle 52 and applying a voltage above 2 kV at the mass analyzer 3.

Figure 13:
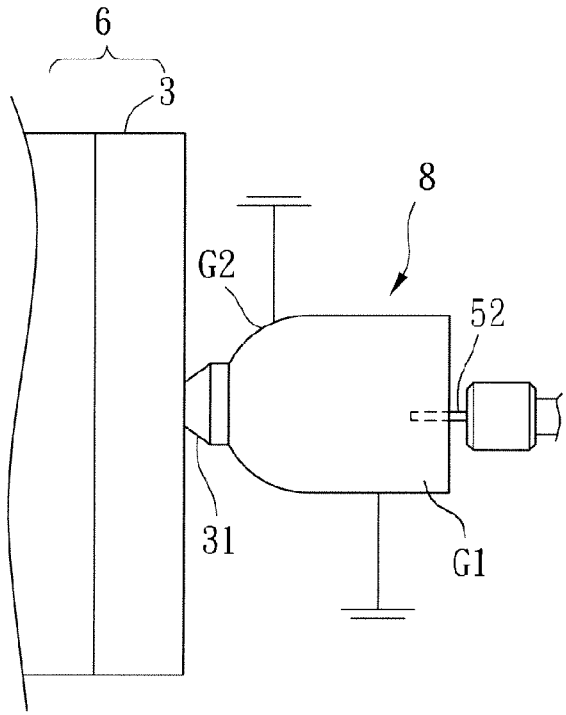
FIG. 13 is a schematic view, illustrating formation of an external electric field between the nozzle of the cycling electrospray ionization device and a mass analyzer of the receiving unit.

Alternatively, an external electric field may be established between the nozzle 52 of the rotating electrospray ionization device 5 and the mass analyzer 3 of the receiving unit 6. As shown in FIG. 13, for example, a glass cloche 8, which includes a cylindrical portion (G1) and a bowl-shaped portion (G2), is provided between the nozzle 52 and the mass analyzer 3, where the cylindrical portion (G1) of the glass cloche 8 proximate to the nozzle 52 is applied thereon a 0.9 kV voltage, and the bowl-shaped portion (G2) of the glass cloche 8 proximate to the mass analyzer 3 is applied thereon a −0.5 kV voltage. As a result, the liquid droplets of the electrospray medium formed at the nozzle 52 are forced to advance toward the mass analyzer 3 under the influence of the external electric field.

Figure 14:
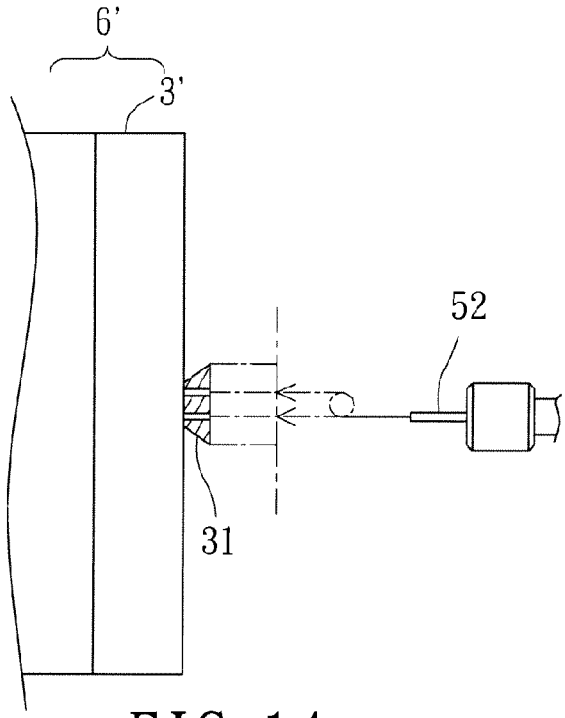
FIG. 14 is a schematic view, illustrating an entrance side of the mass analyzer being annular in shape.

It should be further noted herein that the entrance side 31 of the mass analyzer 3 may be configured in correspondence with the revolving route (A) tracked by the nozzle axis (L1) of the nozzle 52. For instance, the entrance side 31 of the mass analyzer 3 of the receiving unit 6 as illustrated in FIG. 14 is annular in shape in correspondence to the annular revolving route (A).

Figure 15:
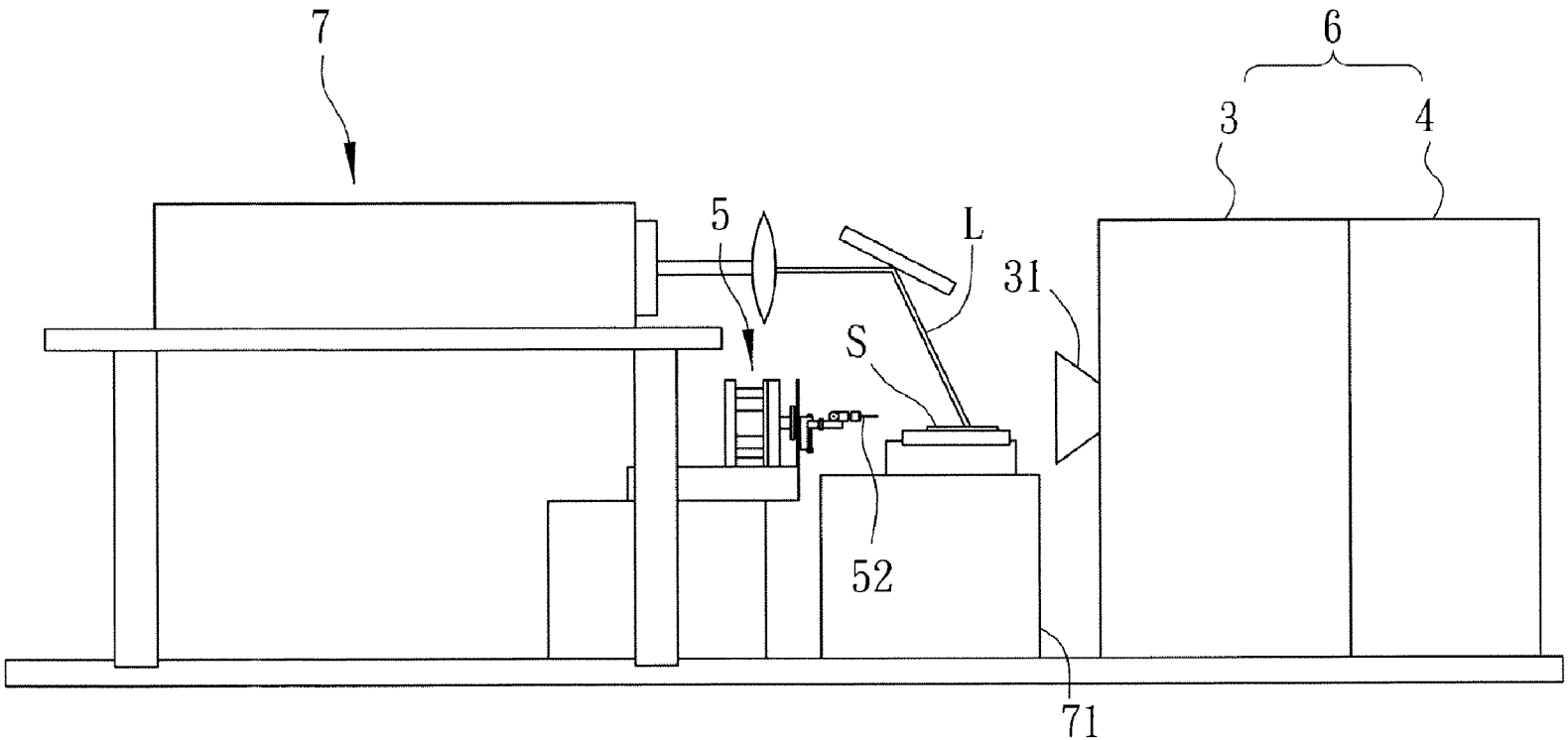
FIG. 15 is a schematic view of an electrospray-assisted laser desorption ionization (ELDI) mass spectrometer that incorporates the cycling electrospray ionization device of the present invention.

Moreover, it should also be noted herein that shown in FIGS. 5, 7, 10 and 11 are common arrangements for electrospray ionization mass spectrometers (ESI-MS). However, the rotating electrospray ionization device of the present invention is applicable to any mass spectrometers that use the electrospray ionization (ESI) technique, an example of which is an electrospray-assisted laser desorption ionization mass spectrometer (ELDI-MS) as disclosed in U.S. Patent Publication No. 2007/0176113 A1, and illustrated in FIG. 15. In FIG. 15, in addition to the rotating electrospray ionization device 5 of the present invention and the receiving unit 6 (which consists of the mass analyzer 3 and the detector 4), the electrospray-assisted laser desorption ionization (ELDI) mass spectrometer further includes a laser desorption device 7. The electrospray medium in the nozzle 52 does not contain analytes, and the laser desorption device 7 is adapted to irradiate a sample (S) disposed on a sample platform 71 with a laser beam (L) such that, upon irradiation, at least one of the analytes contained in the sample (S) is desorbed to fly along a flying path which intersects the traveling path of the liquid droplets of the electrospray medium so as to enable said at least one of the analytes to be occluded in the liquid droplets, and such that as a result of dwindling in size of the liquid droplets when approaching the receiving unit 6 along the traveling path, charges of the liquid droplets will pass on to said at least one of the analytes to form a corresponding one of the ionized analytes.

Figure 16:
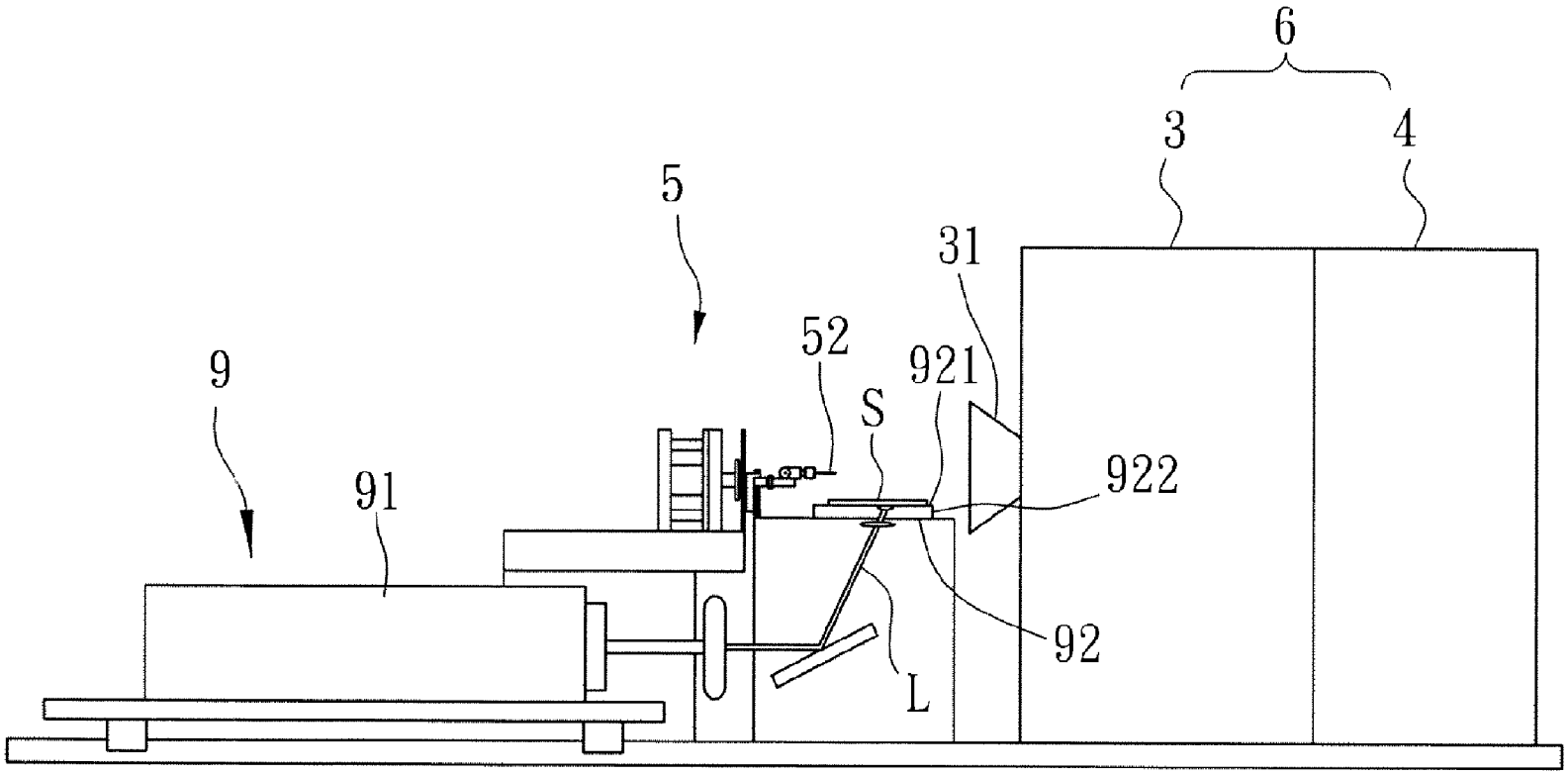
FIG. 16 is a schematic view of a laser-induced acoustic desorption (LIAD) mass spectrometer that incorporates the cycling electrospray ionization device of the present invention.

With reference to FIG. 16, the rotating electrospray ionization device 5 according to the present invention may also be implemented with a laser-induced acoustic desorption (LIAD) device 9 including a laser transmission mechanism 91 and a substrate 92 so as to form a laser-induced acoustic desorption (LIAD) mass spectrometer. The substrate 92 has a sample surface 921 on which the sample (S) is placed, and an irradiated surface 922 opposite to the sample surface 921. The laser transmission mechanism 91 is disposed to irradiate the irradiated surface 922 of the substrate 92 with a laser beam (L). The substrate 92 is made from a material capable of permitting propagation of laser energy there through such that upon irradiation by the laser transmission mechanism 91, laser energy of the laser beam (L) is passed on to at least one of the analytes contained in the sample (S) via the substrate 92 so that the at least one of the analytes is desorbed to fly along a flying path which intersects the traveling path of the charged liquid droplets of the electrospray medium so as to enable the at least one of the analytes to be occluded in the charged liquid droplets. For further details of the LIAD device 9, reference may be made to U.S. Patent Publication No. 2008/0308722 A1.

As discussed above, the rotating electrospray ionization device 5 of the present invention can be applied to any mass spectrometers that involve the use of electrospray ionization (ESI) technique. Therefore, the samples suitable for the present invention can be either solid or liquid.

When the sample is a dissected tissue, it can be a tissue specimen of an animal organ that is selected from the group consisting of a brain, a heart, a liver, a lung, a stomach, a kidney, a spleen, an intestine, and a uterus. In some embodiments of the present invention, the dissected tissue comes from an animal organ that is selected from the group consisting of a brain, a heart, and a liver.

When the sample is formed by dehydrating a liquid material to be studied, the liquid material can be various kinds of solutions, such as body fluids, chemical solutions, environment sampling solutions, or various eluates from liquid chromatography, etc. When the liquid material to be studied is a body fluid secreted by an organism, it can be selected from the group consisting of blood, tear, perspiration, intestinal juice, brains fluid, spinal fluid, lymph, pus, blood serum, saliva, nasal mucus, urine, and excrement. In some embodiments of the present invention, the liquid material to be studied is selected from the group consisting of blood, blood serum, and tear. When the liquid material under study is a chemical solution, it can be insulin, myoglobin, cytochrome c, or a protein solution made from a combination thereof, as illustrated in some of the embodiments disclosed herein.

In summary, the rotating electrospray ionization device 5 of the present invention has the following effects and advantages. By virtue of the revolving motion of the nozzle(s) 52, the liquid droplets sequentially formed at the nozzle (s) 52 are distributed evenly along the traveling path in a space between the nozzle(s) 52 and the receiving unit 6, and such that more ionized analytes formed from the liquid droplets will arrive at the receiving unit 6 as compared to the prior art, where the nozzle is fixed in position when spraying the electrospray solution such that only a small portion of the ionized analytes will reach the receiving unit, while the other are dispersed due to the space charge phenomenon. As a result, intensity and stability of signals obtained by the mass analyzer 3 of the receiving unit 6 are both increased by the present invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A cycling electrospray ionization device adapted for use in a mass spectrometer which is for analyzing analytes, and which includes a receiving unit disposed to admit therein ionized analytes obtainable through ionization of the analytes, said cycling electrospray ionization device comprising:

a driving mechanism; and at least one nozzle configured to sequentially form liquid droplets of an electrospray medium thereat, and adapted to establish a traveling path with the receiving unit such that when a potential difference is applied between said nozzle and the receiving unit to lade the liquid droplets with a plurality of electric charges for ionizing the analytes to form the ionized analytes, the charged droplets are forced to move toward the receiving unit along the traveling path, said nozzle defining a nozzle axis, and being driven by said driving mechanism to proceed with a cycling route about a cycling axis such that said nozzle axis tracks along said cycling route, and such that immediately after leaving said nozzle, the liquid droplets cooperate to form a substantially columnar plume with a cross section substantially surrounded by said cycling route.

2. The cycling electrospray ionization device as claimed in claim 1, wherein said cycling route has two half-route segments which are opposite in location to each other relative to said cycling axis, and which are opposite in direction of movement to each other, said half-route segments being configured to be straightened so as to be close to each other to thereby substantially render said cycling route into a reciprocating route.

3. The cycling electrospray ionization device as claimed in claim 1, wherein said cycling route is a revolving route.

4. The cycling electrospray ionization device as claimed in claim 3, wherein the traveling path is straight.

5. The cycling electrospray ionization device as claimed in claim 3, wherein said driving mechanism includes:

a primary drive module including an output shaft unit that rotates about a rotating axis unit; and a revolving drive module including a revolving shaft unit which defines a shaft axis unit that is offset from said rotating axis unit by a predetermined distance, and which includes a proximate end unit coupled to said output shaft unit so as to be driven to revolve about the rotating axis unit, and a distal end unit coupled to said nozzle so as to bring said revolving route into a predetermined correlation with the predetermined distance.

6. The cycling electrospray ionization device as claimed in claim 5, wherein said rotating axis unit includes two rotating axes, said output shaft unit including two output shafts to rotate respectively about the two rotating axes, said shaft axis unit including two shaft axes, said revolving shaft unit including two revolving shafts which respectively define the two shaft axes, each being offset from a corresponding one of said rotating axes by the predetermined distance, each of said revolving shafts having a distal end part, and a proximate end part to couple to a corresponding one of said output shafts such that said proximate end of each of said revolving shafts is driven to revolve about a corresponding one of the rotating axes, said driving mechanism further including a coupler which has a major wall that defines a centerline normal thereto, and that is configured to secure said nozzle relative thereto so as to render said centerline to be oriented parallel to said nozzle axis in a direction of said nozzle axis, said major wall being configured to have therein two tubular bearing surfaces which are disposed equidistant from said centerline, and which are respectively configured to engage said distal ends of said two revolving shafts such that said revolving route is kept in the predetermined correlation with the predetermined distance.

7. The cycling electrospray ionization device as claimed in claim 6, wherein said primary drive module further includes a motor with a main drive shaft, and a gear train disposed to transmit a drive force of said main drive shaft to drive said two output shafts synchronously.

8. The cycling electrospray ionization device as claimed in claim 7, further comprising a three-way pipe disposed to couple said nozzle to said major wall of said coupler so as to secure said nozzle relative thereto, said three-way pipe having a first conduit which is disposed upstream of said nozzle, a second conduit which is disposed upstream of said first conduit, and which has an inlet for introducing therein the electrospray medium, and a third conduit which is disposed downstream of said second conduit and upstream of said first conduit, and which has a port that is fit with an electrode for establishing the potential difference with the receiving unit.

9. The cycling electrospray ionization device as claimed in claim 8, wherein said nozzle is manifolded into a plurality of sub-nozzles that are parallel to the nozzle axis, at least two of said sub-nozzles being symmetrical relative to the nozzle axis.

10. The cycling electrospray ionization device as claimed in claim 5, wherein the predetermined distance is adjustable.

11. A mass spectrometer for analyzing analytes, comprising:

a receiving unit disposed to admit therein ionized analytes obtainable through ionization of the analytes; and a cycling electrospray ionization device including a driving mechanism, and at least one nozzle configured to sequentially form liquid droplets of an electrospray medium thereat, and establishing a traveling path with said receiving unit such that when a potential difference is applied between said nozzle and said receiving unit to lade the liquid droplets with a plurality of electric charges for ionizing the analytes to form the ionized analytes, the charged droplets are forced to move toward said receiving unit along the traveling path, said nozzle defining a nozzle axis, and being driven by said driving mechanism to proceed with a cycling route about a cycling axis such that said nozzle axis tracks along said cycling route, and such that immediately after leaving said nozzle, the liquid droplets cooperate to form a substantially columnar plume with a cross section substantially surrounded by said cycling route.

12. The mass spectrometer as claimed in claim 11, wherein said cycling route has two half-route segments which are opposite relative to said cycling axis, and which are opposite to each other in direction of movement, said half-route segments being configured to be straightened so as to be close to each other to thereby substantially render said cycling route into a reciprocating route.

13. The mass spectrometer as claimed in claim 11, wherein said cycling route is a revolving route.

14. The mass spectrometer as claimed in claim 11, wherein said receiving has an entrance side that is configured to correspond in shape to said cycling route.

15. The mass spectrometer as claimed in claim 11, further comprising a glass cloche which is disposed between said nozzle and said receiving unit, and which includes a cylindrical portion and a bowl-shaped portion for establishing an external electric field therebetween to serve as the potential difference for forcing the liquid droplets of the electrospray medium formed at said nozzle to advance toward said receiving unit.

* * * * *